US007658075B2

(12) United States Patent
von der Bank

(10) Patent No.: US 7,658,075 B2
(45) Date of Patent: Feb. 9, 2010

(54) LEAN PREMIX BURNER WITH CIRCUMFERENTIAL ATOMIZER LIP

(75) Inventor: Ralf Sebastian von der Bank, Rangsdorf (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 530 days.

(21) Appl. No.: 11/640,362

(22) Filed: Dec. 18, 2006

(65) Prior Publication Data

US 2007/0157617 A1 Jul. 12, 2007

(30) Foreign Application Priority Data

Dec. 22, 2005 (DE) ..... 10 2005 062 079

(51) Int. Cl.
*F02C 1/00* (2006.01)
*F02G 3/00* (2006.01)

(52) U.S. Cl. ..... 60/737; 60/748; 60/740

(58) Field of Classification Search ..... 60/737, 60/748, 740, 776, 742, 743; 431/159
See application file for complete search history.

(56) References Cited

U.S. PATENT DOCUMENTS

| | | | | |
|---|---|---|---|---|
| 3,859,787 | A | 1/1975 | Anderson | |
| 4,168,803 | A | 9/1979 | Simmons | |
| 5,816,049 | A * | 10/1998 | Joshi | 60/737 |
| 6,070,411 | A * | 6/2000 | Iwai et al. | 60/737 |
| 6,367,262 | B1 * | 4/2002 | Mongia et al. | 60/748 |
| 6,381,964 | B1 * | 5/2002 | Pritchard et al. | 60/746 |
| 6,418,726 | B1 * | 7/2002 | Foust et al. | 60/776 |
| 6,560,964 | B2 | 5/2003 | Steinhorsson | |
| 6,631,614 | B2 * | 10/2003 | Mandai et al. | 60/737 |
| 6,668,557 | B2 * | 12/2003 | Ohta et al. | 60/740 |
| 6,986,255 | B2 * | 1/2006 | Smith et al. | 60/776 |
| 7,013,648 | B2 * | 3/2006 | Griffin et al. | 60/737 |
| 7,065,972 | B2 * | 6/2006 | Zupanc et al. | 60/748 |
| 7,140,183 | B2 * | 11/2006 | Ruck et al. | 60/737 |
| 7,340,900 | B2 * | 3/2008 | Xu et al. | 60/737 |
| 2005/0028526 | A1 * | 2/2005 | Von Der Bank | 60/748 |
| 2005/0097889 | A1 * | 5/2005 | Pilatis et al. | 60/743 |
| 2007/0028619 | A1 * | 2/2007 | Spooner | 60/737 |
| 2007/0113556 | A1 * | 5/2007 | Biebel et al. | 60/740 |
| 2007/0169486 | A1 * | 7/2007 | Hernandez et al. | 60/776 |
| 2007/0227147 | A1 * | 10/2007 | Cayre et al. | 60/742 |
| 2007/0289306 | A1 * | 12/2007 | Suria et al. | 60/748 |
| 2008/0053062 | A1 * | 3/2008 | Tuttle | 60/226.1 |

(Continued)

FOREIGN PATENT DOCUMENTS

| | | |
|---|---|---|
| DE | 24 60 709 | 8/1975 |

(Continued)

*Primary Examiner*—William H Rodriguez
(74) *Attorney, Agent, or Firm*—Timothy J. Klima; Shuttleworth & Ingersoll, PLC

(57) ABSTRACT

With a lean premix burner (1), a plurality of preferably V-shaped, closely spaced fuel channels (12) is formed into the circumferential fuel-supplied film application surface (8) of the atomizer lip (9) in the direction of flow, in order to achieve a better heat transfer to the fuel due to the uniform fuel distribution and a transverse flux in the plurality of small fuel flows caused by the Marangoni effect, to completely converse the fuel by early vaporization and improved spraying, to reduce nitrogen oxide emission and to suppress combustion-driven pressure oscillations.

19 Claims, 1 Drawing Sheet

U.S. PATENT DOCUMENTS

Figure 1:
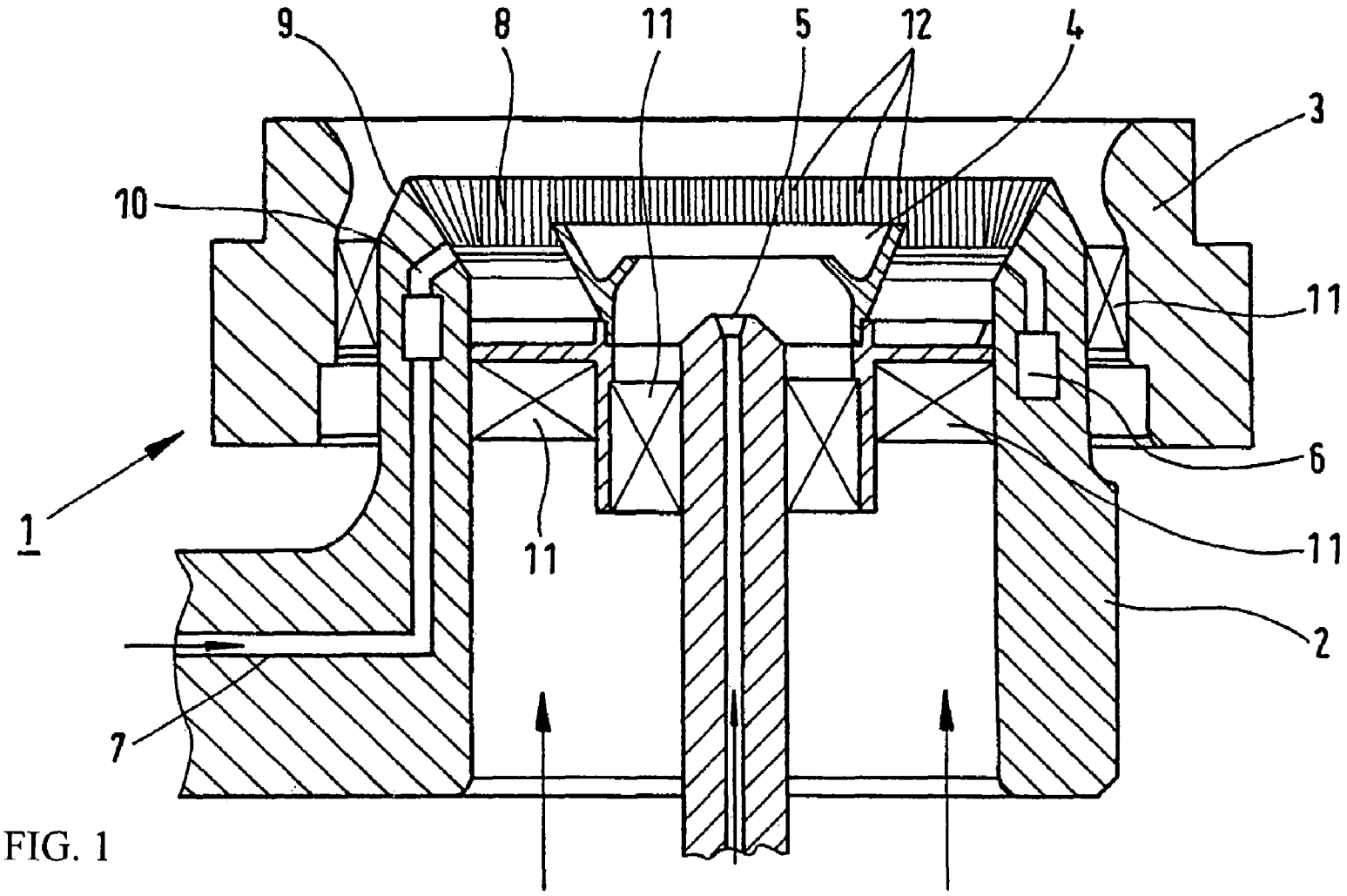

| | | | | |
|---|---|---|---|---|
| 2008/0078181 | A1* | 4/2008 | Mueller et al. | 60/776 |
| 2009/0100837 | A1* | 4/2009 | Von Der Bank | 60/737 |

FOREIGN PATENT DOCUMENTS

| | | | |
|---|---|---|---|
| DE | 28 34 313 | C2 | 7/1990 |
| DE | 696 05 813 | T2 | 6/2000 |
| DE | 103 26 720 | A1 | 12/2004 |
| EP | 0 627 596 | | 4/1998 |
| EP | 0 660 038 | | 5/1998 |
| EP | 0 691 512 | | 11/2002 |
| EP | 0 747 636 | B1 | 3/2003 |
| EP | 1 413 830 | A2 | 4/2004 |
| GB | 2 305 498 | A | 4/1997 |
| WO | WO 97/22806 | | 6/1997 |

* cited by examiner

LEAN PREMIX BURNER WITH CIRCUMFERENTIAL ATOMIZER LIP

This application claims priority to German Patent Application DE 10 2005 062 079.5 filed Dec. 22, 2005, the entirety of which is incorporated by reference herein.

BACKGROUND OF THE INVENTION

This invention relates to a lean premix burner for the combustion chamber of a gas-turbine engine which has an annular central body which connects to a fuel line and employs a circumferential atomizer lip and a fuel-supplied film application surface provided thereon for the generation of an airflow-impinged fuel film.

Combustion chambers of gas-turbine engines can be provided with lean premix burners in order to enable a fuel-air mixture with high content of air to be burned in the combustion chamber at low combustion temperature and with correspondingly reduced formation of nitrogen oxide. In order to ensure ignition of the lean air-fuel mixture under any condition, for example also at low ambient temperatures and correspondingly adverse vaporization behavior, it is further known to combine the lean burner (main burner) with a supporting burner centrally integrated therein. On the burner of this type known from Specification EP 0 660 038 B1, swirler elements are arranged in the annular air feed channels for the supporting burner and the main burner to achieve strong air swirl and maximum mixture of the air with the fuel supplied downstream of the swirler elements. It has already been proposed to provide these swirler elements also in the form of aerodynamic air guide vanes to effect, at increased air mass flow, an even more intense mixture of fuel and air and uniform issue of the fuel-air mixture into the combustion chamber.

Furthermore, burners with an atomizer lip, also termed film applicator, are known, for example from Specification U.S. Pat. No. 6,560,964 B2. The annular atomizer lip, on which a continuous fuel film impinged by a concentric air flow is to be generated, significantly improves the atomization effect and the mixing of fuel and air. However, combustion and pressure oscillations may occur on lean premix burners with film applicators which are disadvantageous for the combustion process in the combustion chamber. To remedy this disadvantage, expensive passive dampers (Helmholtz resonators) are, for example, employed in the combustion chamber.

DESCRIPTION OF THE INVENTION

The present invention, in a broad aspect, provides for the design of a lean premix burner employing a circular atomizer lip for the fuel which improves the mixture of fuel and air and reduces the generation of combustion-driven pressure oscillations.

It is a particular object of the present invention to provide solutions to the above problems by a lean premix burner designed in accordance with the features described herein. Further features and advantageous developments of the present invention will become apparent from the description below.

The present invention, in its essence, provides a plurality of closely spaced fuel channels formed into the film application surface of the atomizer lip to ensure uniform distribution of fuel on the film application surface and avoid separation of the fuel film into individual streaks, this effect already providing good heat transfer from both the atomizer lip and the supplied air to the fuel film or avoiding singular fuel overheating, respectively. Moreover, since the temperature is lower in the middle area than in the outward area of the individual fuel channels and surface tension at the interface between fuel and air is correspondingly higher in this area, the resultant gradients in surface tension give rise to a Marangoni circulation, i.e. a transverse flux in the small fuel flows of the fuel channels which even more improves heat transfer from the atomizer lip and the air to the fuel. Increased fuel temperature leads to improved, early vaporization of the fuel and a fine, well mixed spray, enabling the fuel to be completely conversed and providing for reduced nitrogen oxide emission and suppression of combustion-driven pressure oscillations.

Cross-sectional shape and size of the fuel channels in the film application surface are provided such that the gradient in the surface tension at the interface between fuel and air is maximized in order to achieve an efficient transverse flux (Marangoni circulation). Preferably, the fuel channels are V-shaped or trapezoidal and cross-sectionally dimensioned such that they are almost completely filled with fuel.

In a further development of the present invention, swirler elements can be arranged in the fuel channels to further enhance heat transfer to the fuel flow by the swirling effect so provided.

An embodiment of the present invention is illustrated in the attached FIG. 1 which shows, in sectional view, a lean premix burner which is provided with an atomizer lip arranged in the main airflow for the mixing of air and fuel.

The lean premix burner 1 integrated in the wall of the combustion chamber of a gas-turbine features an annular central body 2 which, on the one hand, is surrounded by an outer ring 3 and in which, on the other hand, a supporting burner 5 surrounded by a flame stabilizer 4 and separately supplied with fuel is centrally arranged. The central body 2 has an annulus 6 which is supplied with fuel via a fuel line 7. The central body 2 features, on the fuel exit side, an atomizer lip 9 in the form of a conically flaring front face or film application surface 8. Issuing at the front face of the central body, i.e. the conically flaring, circumferential film application surface 8, is a narrow fuel distribution duct 10 originating at the annulus 6 to uniformly supply fuel at the circumference of the atomizer lip 9 and to produce a thin fuel film on the film application surface 8 of the atomizer lip 9. Swirler elements 11 which supply and pre-mix, or mix, air with fuel are arranged in the respective annular gaps between the outer ring 3 and the central body 2, the central body 2 and the flame stabilizer 4 as well as the flame stabilizer 4 and the supporting burner 5.

Formed into the film application surface 8 is a plurality of essentially parallel, closely spaced fuel channels 12 with triangular (V-shaped) cross-section extending towards the leading edge of the atomizer lip 9, i.e. in the direction of flow. These fuel channels 12 ensure that the fuel issued via the fuel distribution channel 10 to the film application surface 8 is completely uniformly distributed on the inner circumference of the atomizer lip 9, thereby enabling the fuel to be uniformly heated and intensely mixed with the air supplied. That is, uncontrolled separation of the fuel film in circumferential direction and formation of individual, small fuel flows on the film application surface 8—occurring particularly with very thin fuel films—is avoided. The tendency of lean premix burners with atomizer lips to produce combustion-driven pressure oscillations is reduced. Owing to the uniformity of the film, heat transfer from the solid body and from the air to the fuel is improved. Partial fuel overheating is reduced. The fuel can vaporize early and break into a fine spray well mixed with the air supplied, ensuring complete combustion and low NOx content.

The fuel channels 12 formed into the film application surface 8 of the atomizer lip 9 preferably feature, as mentioned above, a triangular or trapezoidal cross-sectional surface dimensioned such that they are essentially completely filled with fuel. Other cross-sectional shapes can also be employed. The higher temperature and correspondingly lower surface tension of the fuel in the wall-near areas of the fuel channels 12 and the lower temperature and correspondingly higher surface tension of the fuel in the middle, wall-remote area of the fuel channels 12 give rise to a microcirculation of the fuel over the channel cross-section. By this, the transfer of heat to the liquid fuel and the heating-up of the fuel film is further improved, thereby even intensifying the above, advantageous effects. Cross-sectional shape and size required for microcirculation are determined by calculation in accordance with the temperature and tension conditions to be expected.

Profiling the fuel channels 12 to produce longitudinally arranged swirler elements (not shown) provides a further means to mix the fuel film in the fuel channels 12 and to improve heat transfer.

LIST OF REFERENCE NUMERALS

1 Lean premix burner
2 Central body of 1
3 Outer ring of 1
4 Flame stabilizer of 1
5 Supporting burner of 1
6 Annulus of 2
7 Fuel line of 6
8 Film application surface of 9
9 Atomizer lip
10 Fuel distribution duct of 9
11 Swirler-elements
12 Fuel channels

What is claimed is:

1. A lean premix burner for a combustion chamber of a gas-turbine engine comprises:

an annular central body which connects to a fuel line, a circumferential atomizer lip positioned on the annular central body, a fuel-supplied film application surface provided on the circumferential atomizer lip for the generation of an airflow-impinged fuel film, a plurality of adjacent fuel channels formed into the film application surface in a flow direction, to produce a plurality of small fuel flows and to uniformly distribute the fuel in a circumferential direction of the atomizer lip, the cross-sectional shape and size of the fuel channels being selected such that a circulation of the small fuel flows perpendicular to their direction of flow is effected due to a Marangoni effect.

2. A lean premix burner in accordance with claim 1, wherein the fuel channels for producing the Marangoni circulation have at least one of an essentially triangular and an essentially trapezoidal cross-sectional shape so that, due to temperature difference, a surface tension of the fuel flow is lower in wall-near areas than in a middle area, with a gradient in surface tension resulting in fuel circulation in the fuel channel.

3. A lean premix burner in accordance with claim 2, wherein a fuel quantity supplied to the atomizer lip and a size of the individual fuel channels are matched with each other such that the fuel channels are essentially filled with fuel.

4. A lean premix burner in accordance with claim 3, and further comprising mechanical swirler elements arranged on inner surfaces of the fuel channels to enhance a swirling effect on the small fuel flows.

5. A lean premix burner in accordance with claim 4, wherein the swirler elements are formed by at least one of a wavy and an edged side wall profile.

6. A lean premix burner in accordance with claim 5, wherein the fuel channels are formed into the film application surface such that they lie adjacent to each other.

7. A lean premix burner in accordance with claim 1, wherein a fuel quantity supplied to the atomizer lip and a size of the individual fuel channels are matched with each other such that the fuel channels are essentially filled with fuel.

8. A lean premix burner in accordance with claim 7, and further comprising mechanical swirler elements arranged on inner surfaces of the fuel channels to enhance a swirling effect on the small fuel flows.

9. A lean premix burner in accordance with claim 8, wherein the swirler elements are formed by at least one of a wavy and an edged side wall profile.

10. A lean premix burner in accordance with claim 9, wherein the fuel channels are formed into the film application surface such that they lie adjacent to each other.

11. A lean premix burner in accordance with claim 1, and further comprising mechanical swirler elements arranged on inner surfaces of the fuel channels to enhance a swirling effect on the small fuel flows.

12. A lean premix burner in accordance with claim 11, wherein the swirler elements are formed by at least one of a wavy and an edged side wall profile.

13. A lean premix burner in accordance with claim 12, wherein the fuel channels are formed into the film application surface such that they lie adjacent to each other.

14. A lean premix burner in accordance with claim 1, wherein the fuel channels are formed into the film application surface such that they lie adjacent to each other.

15. A lean premix burner in accordance with claim 2, wherein the fuel channels are formed into the film application surface such that they lie adjacent to each other.

16. A lean premix burner in accordance with claim 3, wherein the fuel channels are formed into the film application surface such that they lie adjacent to each other.

17. A lean premix burner in accordance with claim 4, wherein the fuel channels are formed into the film application surface such that they lie adjacent to each other.

18. A lean premix burner in accordance with claim 7, wherein the fuel channels are formed into the film application surface such that they lie adjacent to each other.

19. A lean premix burner in accordance with claim 11, wherein the fuel channels are formed into the film application surface such that they lie adjacent to each other.

* * * * *